US007382261B2

(12) United States Patent
Lin et al.

(10) Patent No.: US 7,382,261 B2
(45) Date of Patent: Jun. 3, 2008

(54) RADIO FREQUENCY IDENTIFICATION SECURITY SYSTEM AND METHOD

(75) Inventors: Hsiang-Chang Lin, Taipei (TW); Yi-Hung Shen, Taipei (TW)

(73) Assignee: Compal Electronics, Inc., Taipei (TW)

( * ) Notice: Subject to any disclaimer, the term of this patent is extended or adjusted under 35 U.S.C. 154(b) by 239 days.

(21) Appl. No.: 11/256,973

(22) Filed: Oct. 25, 2005

(65) Prior Publication Data

US 2006/0186994 A1 Aug. 24, 2006

(30) Foreign Application Priority Data

Feb. 5, 2005 (TW) ..... 94104052 A

(51) Int. Cl.
*G08B 13/14* (2006.01)

(52) U.S. Cl. ..... 340/572.1; 340/572.4

(58) Field of Classification Search ..... 340/572.1, 340/572.4, 572, 572.8, 572.9, 568.1, 571, 340/539.11, 5.3, 5.4, 5.81; 235/380, 382
See application file for complete search history.

(56) References Cited

U.S. PATENT DOCUMENTS 6,717,507 B1 * 4/2004 Bayley et al. ..... 340/5.1
7,053,771 B2 * 5/2006 Hussmann ..... 340/539.11
7,108,177 B2 * 9/2006 Brookner ..... 235/382

* cited by examiner

*Primary Examiner*—Van T. Trieu

(57) ABSTRACT

A predetermined ID code is set in a server, and a radio frequency identification (RFID) tag is configured on an electronic device. A tag ID code of the RFID tag is received by a reader and then is transmitted to the server. The server is used to compare the tag ID code and the predetermined ID code. When the tag ID code is the same as the predetermined ID code, the server is arranged to transmit an enable signal to grant the access of the electronic device. When the tag ID code is different from the predetermined ID code, the server is arranged to send a disable signal to deny the access of the electronic device.

8 Claims, 5 Drawing Sheets

RADIO FREQUENCY IDENTIFICATION SECURITY SYSTEM AND METHOD

RELATED APPLICATIONS

The present application is based on, and claims priority from, Taiwan Application Serial Number 94104052, filed Feb. 5, 2005, the disclosure of which is hereby incorporated by reference herein in its entirety.

BACKGROUND

1. Field of Invention

The present invention relates to a radio frequency identification (RFID) system. More particularly, the present invention relates to an apparatus and method for protecting the hardware and data of an electronic device by a server and an RFID tag.

2. Description of Related Art

All kinds of electronic devices change with each passing day, developed to be lighter, thinner and smaller. Unfortunately, these thinner and smaller electronic devices are easily stolen by others. A conventional security mechanism is generally to set a password in the electronic device in advance, and require password inputting or fingerprint identification to prevent the thief from using the electronic device or accessing data stored in the electronic device. However, the thief may execute the reset function of the electronic device, sacrificing the data stored inside but regaining the use of the electronic device. In other words, the conventional security mechanism is possibly able to protect the data stored in the electronic device from being divulged, but seems incapable of preventing the stolen or lost electronic device from being used by others.

In another aspect, these thinner and smaller electronic devices have become an unspoken worry in the information security issue. For example, a research and development department usually sets up a restricted area in the company, where entry and exit of the staff and electronic devices are monitored to prevent divulgence of the confidential research and development data. However, persons having ulterior motives can smuggle thinner and smaller portable electronic devices, such as notebook computers, personal digital assistants (PDAs), mobile disks, recorder pens or digital cameras, into the restricted area, forming a loophole in information security.

SUMMARY

It is therefore an aspect of the present invention to provide a radio frequency identification (RFID) security method, which can control and manage the access of an electronic device and enhance the perimeter security of the electronic device in a certain region.

According to a first preferred embodiment of the present invention, the RFID security method sets a predetermined ID code in a server. A reader receives a tag ID code of an RFID tag and transmits the tag ID code to the server. The RFID tag is configured on an electronic device. The server then determines whether the tag ID code is the same as the predetermined ID code. When the tag ID code is the same as the predetermined ID code, the server transmits an enable signal to the RFID tag to grant an access of the electronic device through a controller of the electronic device; when the tag ID code is different from the predetermined ID code, the server transmits a disable signal to the RFID tag to deny the access of the electronic device through the controller of the electronic device.

It is another aspect of the present invention to provide an RFID security system, which protects the hardware and stored data of an electronic device and controls and manages the access to prevent the hardware or stored data from being stolen or divulged.

According to a second preferred embodiment of the present invention, the RFID security system comprises an electronic device, a reader and a server. The electronic device has an RFID tag, and the RFID tag corresponds to a tag ID code. The reader receives the tag ID code. The server is electrically connected to the reader and has a predetermined ID code. The server receives the tag ID code from the reader and determines whether the tag ID code is the same as the predetermined ID code. When the tag ID code is the same as the predetermined ID code, the server transmits an enable signal to the electronic device to grant an access of the electronic device through a controller of the electronic device; when the tag ID code is different from the predetermined ID code, the server transmits a disable signal to the electronic device to deny the access of the electronic device through the controller of the electronic device.

It is to be understood that both the foregoing general description and the following detailed description are examples and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
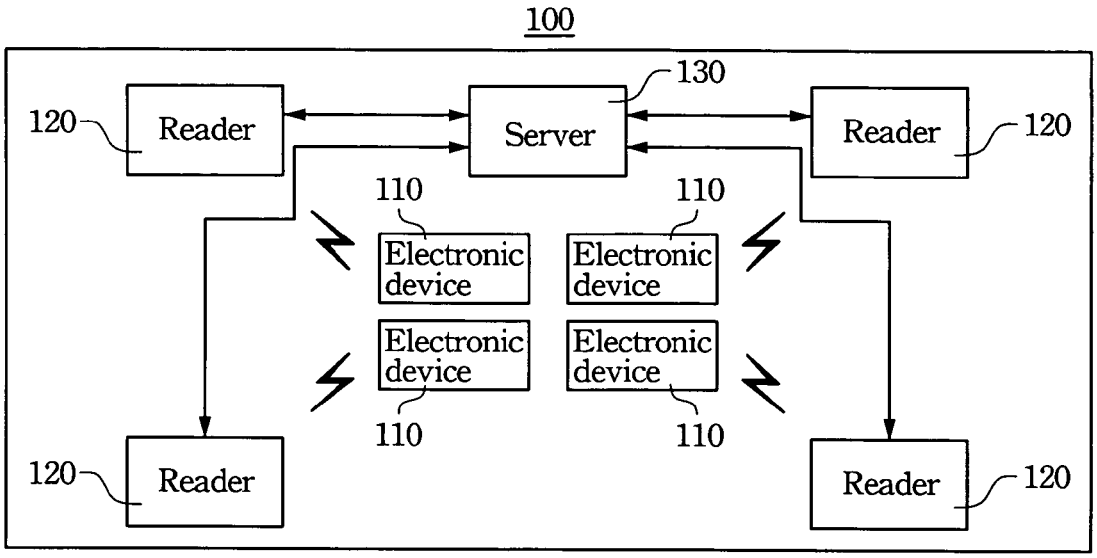
FIG. 1 is a schematic view of a first preferred embodiment of the present invention.

Reference will now be made in detail to the preferred embodiments of the present invention, examples of which are illustrated in the accompanying drawings. Wherever possible, the same reference numbers are used in the drawings and the description to refer to the same or like parts.

Radio frequency identification (RFID) is a non-contact automatic identification technique, which automatically identifies targets and obtains relative information by radio frequency signals, so as to have a fast and convenient process, omit manual operations during identifying, and be able to identify plural tags, even for dynamic targets, simultaneously. RFID is easily controlled, simple and practical, and especially applicable to automatic control techniques because it can be operated not only in read-only mode but also in read/write mode.

A complete RFID system comprises two parts, a reader and a transponder. The transponder is generally called an RFID tag. The operational principle of the RFID system is to transmit radio frequency energy of a certain frequency to the transponder for driving it to transmit its tag ID code, or alternatively, to transmit the tag ID code by the transponder itself. The reader receives the tag ID code and transmits it to a central system for carrying out relative data processing.

The present invention protects the hardware and data of the electronic device by the wireless communication and the fast access of the RFID system, and further can control and manage the access to prevent the hardware or stored data from being stolen or divulged.

FIG. 1 is a schematic view of a first preferred embodiment of the present invention. As illustrated in FIG. 1, an RFID security system 100 comprises at least one electronic device 110, at least one reader 120, and a server 130. Every electronic device 110 has an RFID tag, and the RFID tag corresponds to a tag ID code representing the electronic device 100 on which the RFID tag is attached. The reader 120 receives the tag ID code. The server 130 stores a predetermined ID code and is electrically connected to the reader 120. The server 130 receives the tag ID code from the reader 120 and determines whether the tag ID code is the same as the predetermined ID code. When the tag ID code is the same as the predetermined ID code, the server 130 transmits an enable signal to the electronic device 110 to grant an access of the electronic device 100; when the tag ID code is different from the predetermined ID code, the server 130 transmits a disable signal to the electronic device 110 to deny the access of the electronic device 110.

The electronic device 110 can be a portable electronic device or other electronic device with turn-on and turn-off functions. In the preferred embodiments, the electronic device 110 is a portable electronic device, such as a notebook computer, a PDA, a mobile phone, a mobile disk, a digital camera or other electronic device taken along with the user.

Figure 2:
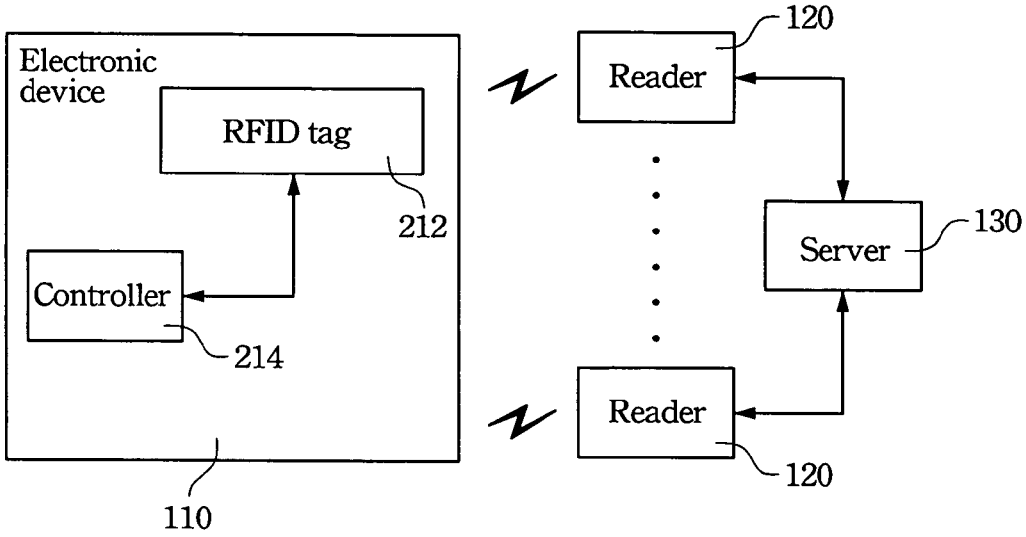
FIG. 2 is a schematic view of the electronic device in the first preferred embodiment of the present invention.

FIG. 2 is a schematic view of the electronic device in the first preferred embodiment of the present invention. As illustrated in FIG. 2, the electronic device 110 has an RFID tag 212 and a controller 214. The server 130 can transmit the enable signal or the disable signal to the RFID tag 212 through the reader 120. Alternatively, the sever 130 can transmit the enable signal or the disable signal to the electronic device 110 through the network (e.g. the wireless network) or other electrical connection. The controller 214 grants or denies the access of the electronic device 110 according to the enable signal or the disable signal.

In addition to standing alone, the controller 214 can be integrated into an embedded controller (EC) because the portable electronic device used in the first preferred embodiment generally contains the embedded controller inside. In another aspect, the RFID tag 212 can be adhered on the electronic device 110; alternatively, partial elements of the RFID tag 212 can be integrated into the embedded controller and selectively associated with the antenna (such as a Bluetooth antenna or WLAN antenna) and the power supply originally configured on the electronic device 110, thus obtaining a built-in RFID tag 212 in the electronic device 110.

Moreover, the embedded controller is used to control the system settings of the electronic system 110, such as the battery setting, backlight setting, power-saving setting or direct playing function. Therefore, when the electronic device 110 is turned off, the foregoing enable signal can be a power-on password for turning on the electronic device 110. Similarly, when the electronic device 110 is suspended or idled, the foregoing enable signal can be a recovery signal or password such that the electronic device 110 returns from the suspend mode to the operating mode.

Figure 3:
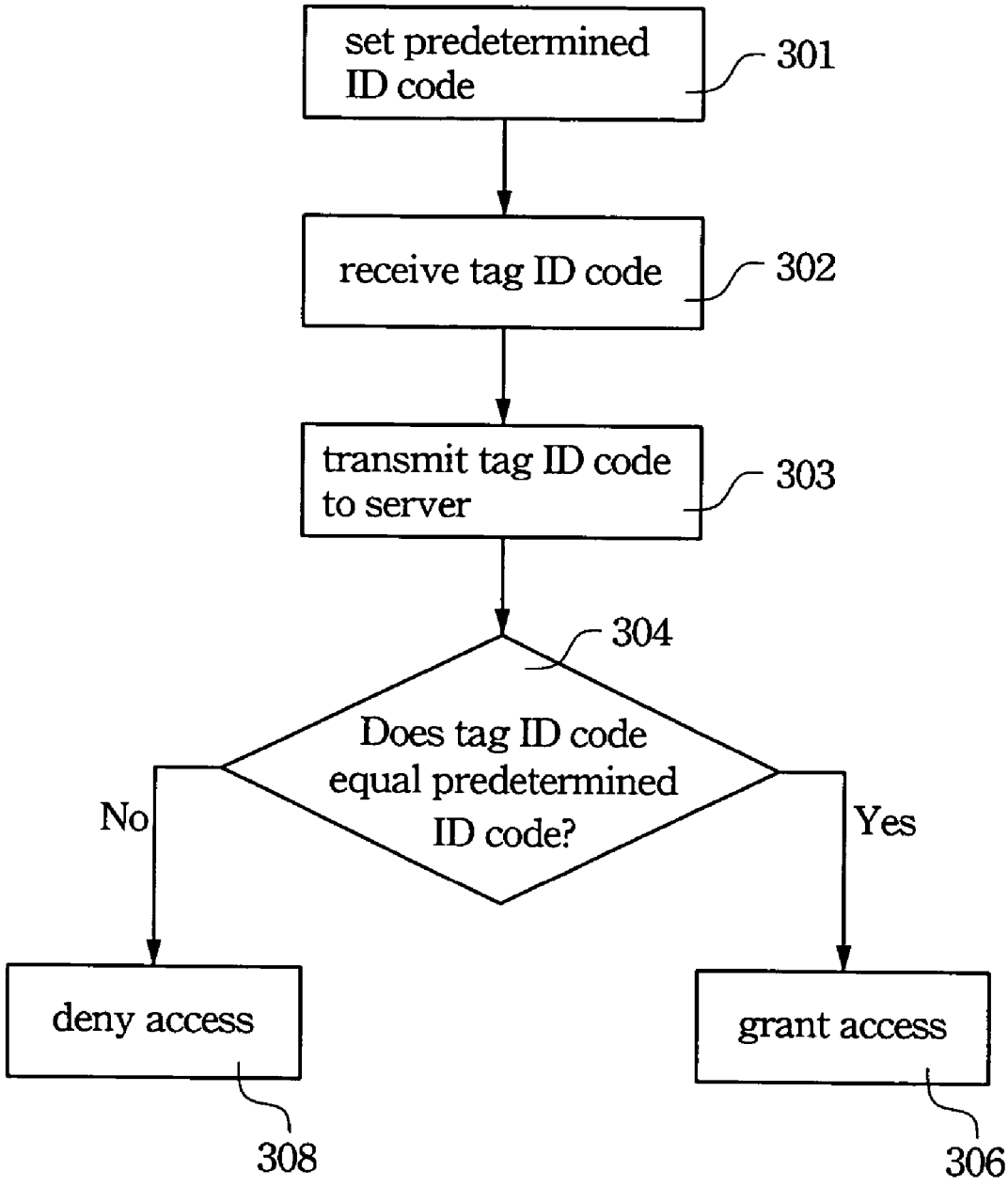
FIG. 3 is a flow chart of the first preferred embodiment of the present invention.

FIG. 3 is a flow chart of the first preferred embodiment of the present invention, illustrating the RFID security method of the present invention. For clarity, the following description is made with reference to FIG. 1, FIG. 2 and FIG. 3. The RFID security method sets a predetermined ID code in a server 130 (step 301). The reader 120 receives the tag ID code of the RFID tag 212 (step 302) and transmits the tag ID code to the server 130 (step 303). The RFID tag 212 is configured on the electronic device 100.

The server 130 then determines whether the tag ID code is the same as the predetermined ID code (step 304). When the tag ID code is the same as the predetermined ID code, the server 130 transmits the enable signal to the RFID tag 212 to grant the access of the electronic device 110 through the controller 214 of the electronic device 110 (step 306); when the tag ID code is different from the predetermined ID code, the server 130 transmits the disable signal to the RFID tag 212 to deny the access of the electronic device 110 through the controller 212 of the electronic device 110 (step 308).

The following description particularly explains how to set the predetermined ID code in the server 130 in the first preferred embodiment. Firstly, the system administrator of the RFID security system 100, such as a information security officer of the company, can directly set the access of every electronic device 110 by the server 130, directly setting the tag ID code corresponding to the electronic device of which the access is granted as the predetermined ID code. In this case, the RFID security system 100 is more suitable for the system administrator to manage and control the electronic devices 110 positioned within a certain region. The system administrator can install several readers 120 at different positions within the region to achieve the regional management.

Alternatively, the user can provide a tag ID code corresponding to a certain electronic device 110 to the server 130 though the network (e.g. the wireless network) or other suitable device. The server 130 can follow the setting to simply record or check if the provided tag ID code is on the permission list, or report the provided tag ID code to the system administrator for requesting a decision, and then set the recorded or the permitted tag ID code as the predetermined ID code.

In this case, the RFID security system 100 is more suitable for an automatic management of the perimeter security. For example, when the user taking the electronic device 110 enters or exits the region, near the entrance or the exit of the region, the user must apply to the server 130 for clearance. The server 130 is responsible for controlling whether or not the electronic device 110 can still be available after entering or exiting the region. If not, the server 130 will deny the access of the electronic device 110 to protect the hardware and prevent the stored data from being divulged.

Figure 4:
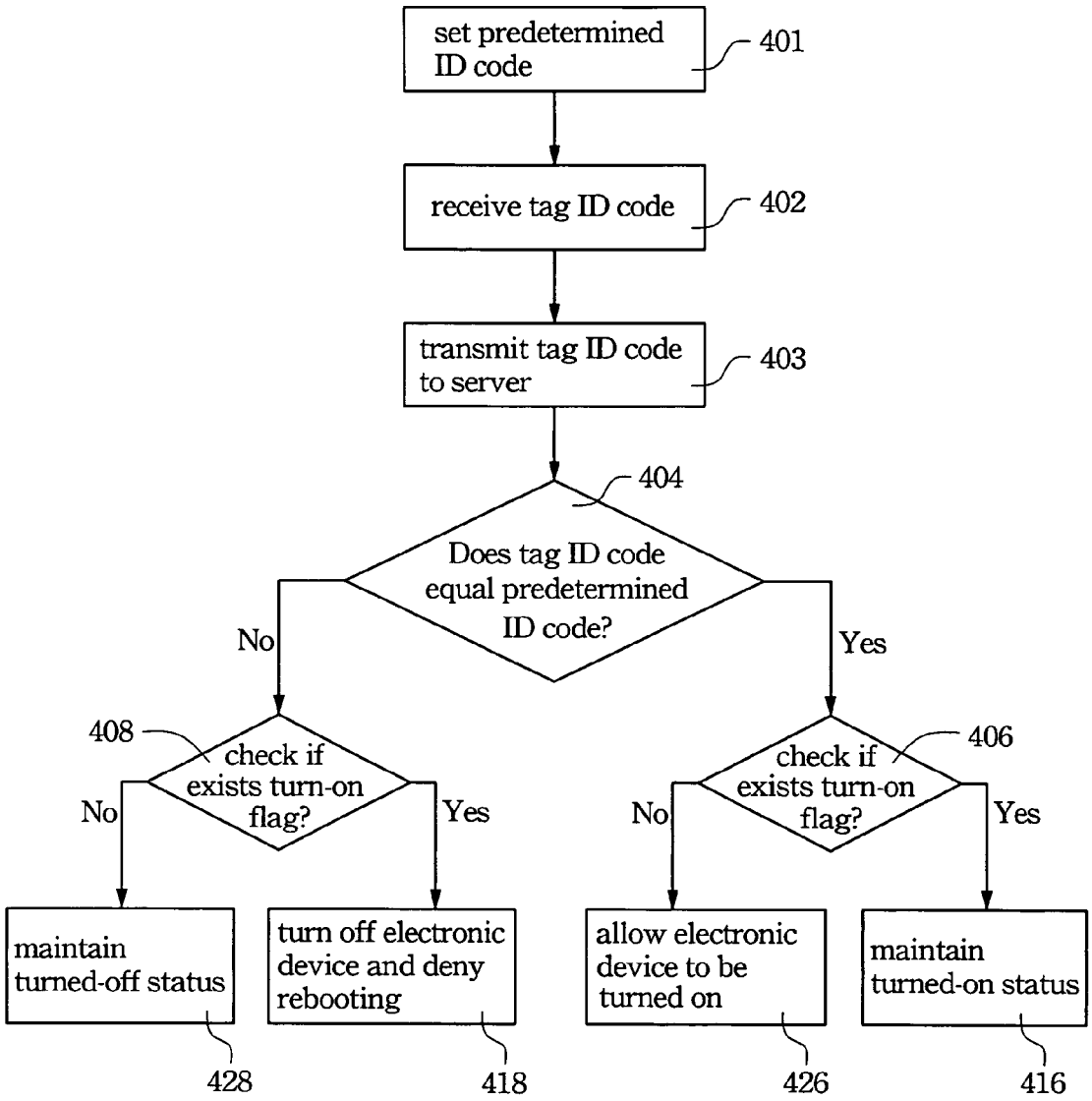
FIG. 4 is a flow chart of a second preferred embodiment of the present invention.

FIG. 4 is a flow chart of a second preferred embodiment of the present invention. Compared to the first preferred embodiment in the FIG. 3, the second preferred embodiment has an additional check mechanism for checking a turn-on flag. The user can thus have a further security action according to the turned-on or turned-off status of the electronic device 110.

For clarity, the following description is made with reference to FIG. 1, FIG. 2 and FIG. 4. The RFID security method sets a predetermined ID code in a server 130 (step 401). The reader 120 receives the tag ID code of the RFID tag 212 (step 402) and transmits the tag ID code to the server 130 (step 403). The RFID tag 212 is configured on the electronic device 100. The server 130 then determines whether the tag ID code is the same as the predetermined ID code (step 404).

Then, no matter whether the tag ID code is the same as the predetermined ID code or not, the second preferred embodiment proceeds a turn-on flag checking step, for checking whether the electronic device 110 is turned on or not at this moment (steps 406 and 408). When the turn-on flag exists, the electronic device 110 is turned on; when the turn-on flag is absent, the electronic device 110 is turned off.

When the tag ID code is the same as the predetermined ID code and the turn-on flag exists, the electronic device 110 maintains its turned-on status (step 416). When the user ID code is the same as the user password and the turn-on flag is absent, the electronic device 110 is allowed to be turned on (step 426). Moreover, as stated above, the enable signal can selectively include a power-on password or system setting instructions, facilitating user manipulation. The power-on password is inputted during the booting of the electronic device 110, and the system setting instructions selectively can automatically complete the booting of the electronic device 110 when finishing the determination of tag ID code, or automatically log in to the system without inputting the password when the user turns on the electronic device 100 by himself.

On the other hand, when the tag ID code is different from the predetermined ID code and the turn-on flag exists, the second preferred embodiment turns off the electronic device 110 and does not allow the electronic device 110 to be turned on again (i.e. rebooting) (step 418), or instantly turns off the electronic device 110 or does not allow the electronic device 110 to be turned on again after it has been turned on. When the tag ID code is different from the predetermined ID code and the turn-on flag is absent, the electronic device 110 maintains its turned-off status (step 428).

Figure 5:
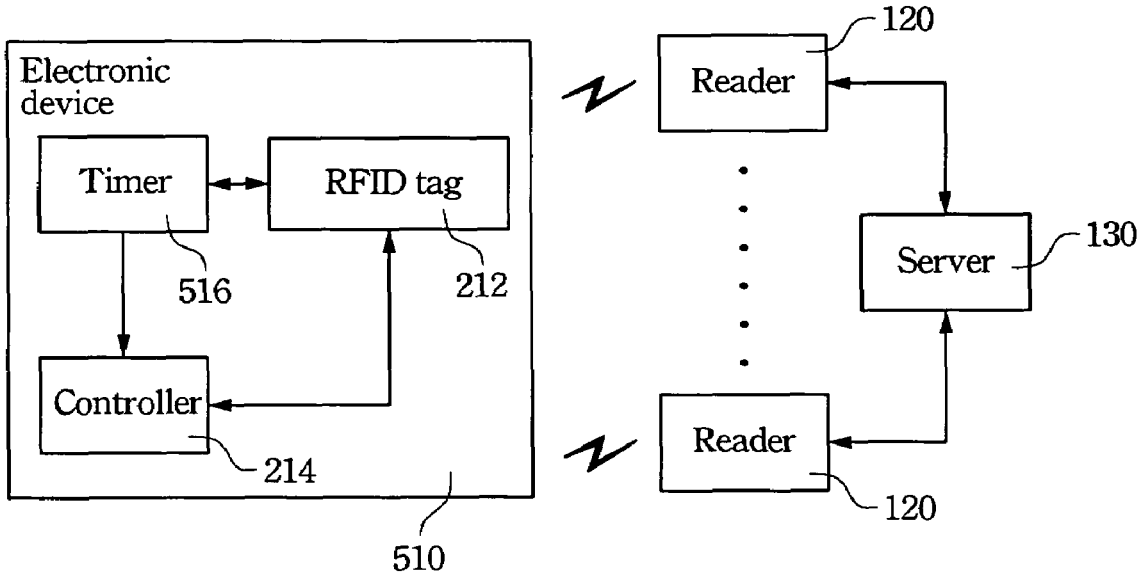
FIG. 5 is a schematic view of the electronic device in the second preferred embodiment of the present invention.
Figure 6:
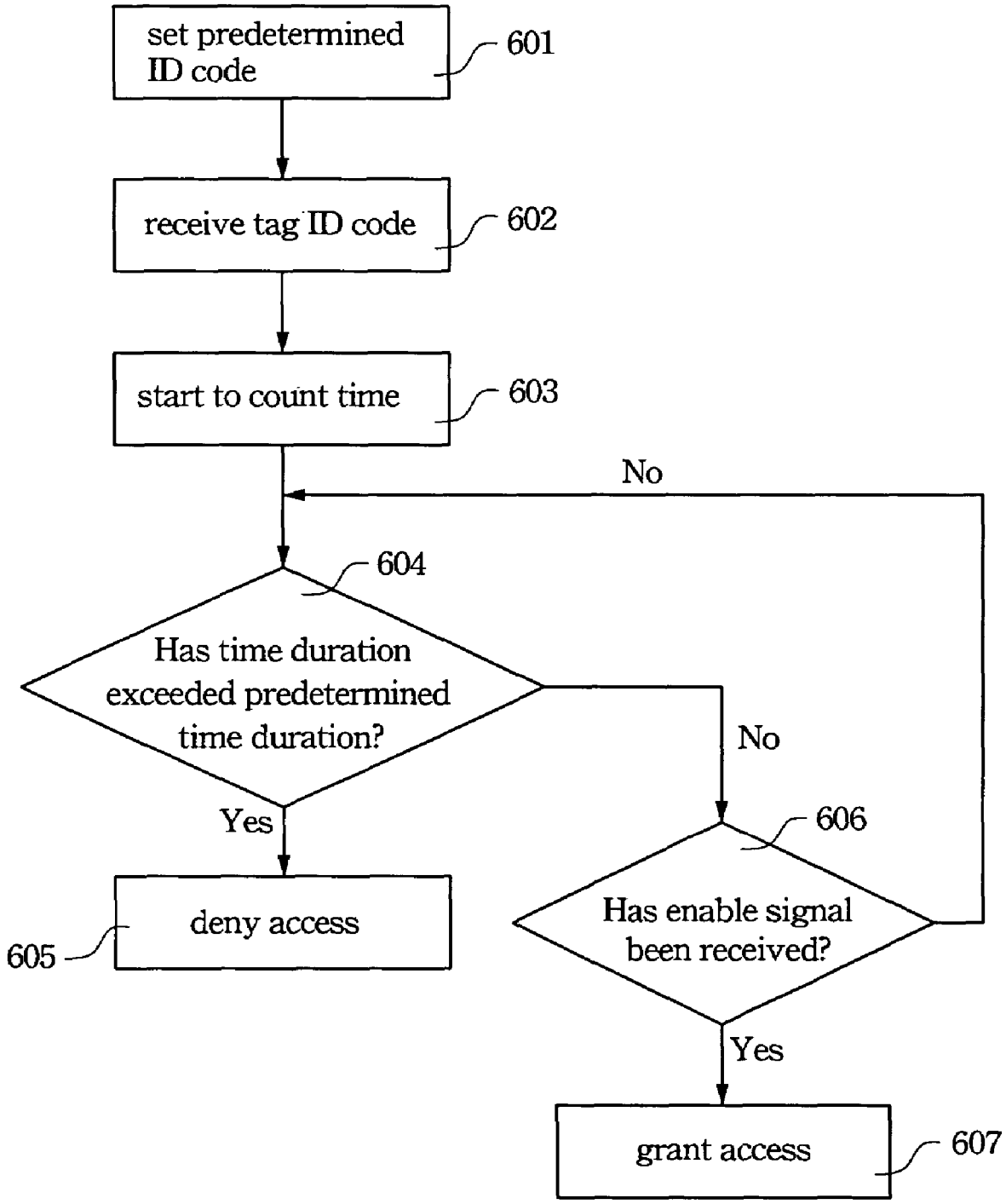
FIG. 6 is another flow chart of the second preferred embodiment of the present invention.

FIG. 5 is a schematic view of the electronic device in the second preferred embodiment of the present invention, and FIG. 6 is another flow chart of the second preferred embodiment of the present invention. Compared to the preferred embodiment as illustrated in FIG. 1, the second preferred embodiment adds a timer 516 to the electronic device 510. When the reader 120 transmits a trigger signal to the RFID tag 212, the tag ID code is transmitted to the server 130 though the reader 120, and the timer starts to count a duration of time. The controller 214 denies the access of the electronic device 510 when the duration of time exceeds a predetermined time duration. In other words, the timer 512 of the second preferred embodiment counts down for denying the access of the electronic device 510. In addition, the timer 516 can, in addition to the controller 214, be built into the foregoing embedded controller.

More precisely, the second preferred embodiment makes the electronic device firstly enter the countdown to turn-off process after the tag ID code is transmitted to the server, and then dismiss the countdown to turn-off process by the subsequent enable signal, thus preventing someone from escaping the later disable signal transmitted from the server by quickly leaving the region. Therefore, the second preferred embodiment is especially suitable for the management of the portable electronic devices within the region of the high-security classification. For example, the reader 120 can be configured on the exit of the restricted area. Every electronic device 510 which tends to leave from the exit has to be identified by the server 130 through the reader configured on the exit and then is allowed to be continuously available after leaving the region.

For clarity, the following description is made with reference to FIG. 5 and FIG. 6. The RFID security method sets a predetermined ID code in a server 130 (step 601). The reader 120 receives the tag ID code of the RFID tag 212 and transmits the tag ID code to the server 130 (step 602). The server 130 transmits a trigger signal to the RFID tag through the reader, enabling the timer of the electronic device to start to count the duration of time (step 603). Then, whether the duration of time exceeds the predetermined time duration or not is determined (step 604). When the duration of time exceeds the predetermined time duration, the access of the electronic device 510 is denied (step 605). In this situation, even if someone wants to take the electronic device away very quickly to dodge the disable signal transmitted from the server, the electronic device has already entered the countdown to turn-off process in advance, preventing any possibility of data divulgence.

On the other hand, when the duration of time does not exceed the predetermined time duration, the controller 214 determines whether or not the enable signal transmitted from the server 130 has been received (step 130). If the enable signal has not been received, the controller 214 makes the timer 516 keep counting the duration of time, and determines whether the duration of time exceeds the predetermined time duration (step 604). When the enable signal is received before the duration of time exceeds the predetermined time duration, the access of the electronic device 110 is granted (step 607) and the controller 214 makes the timer 516 stop counting the duration of time and reset the counting status of the time duration. Therefore, the second preferred embodiment of the present invention can substantially enhance the perimeter security of the electronic device in a certain region, ensuring that the user must use the electronic device leaving from the restricted area with permission.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A radio frequency identification (RFID) security system, comprising:

an electronic device having an RFID tag, wherein the RFID tag corresponds to a tag ID code;

a reader arranged to receive the tag ID code;

a server electrically connected to the reader and having a predetermined ID code, the server arranged to receive the tag ID code from the reader and determine whether the tag ID code is the same as the predetermined ID code, wherein when the tag ID code is the same as the predetermined ID code, the server is arranged to transmit an enable signal to the electronic device to grant an access of the electronic device through a controller of the electronic device, and when the tag ID code is different from the predetermined ID code, the server is arranged to transmit a disable signal to the electronic device to deny the access of the electronic device through the controller of the electronic device; and a timer arranged to count a duration of time after the tag ID code is transmitted to the server, wherein the controller is arranged to deny the access of the electronic device when the duration of time exceeds a predetermined time duration.

2. The RFID security system as claimed in claim 1, wherein the controller is an embedded controller.

3. The RFID security system as claimed in claim 1, wherein the electronic device is a portable electronic device.

4. The RFID security system as claimed in claim 1, wherein when the electronic device receives the enable signal before the duration of time exceeds the predetermined time duration, the timer is arranged to stop counting the duration of time.

5. The RFID security system as claimed in claim 1, wherein the timer is built in an embedded controller.

6. A radio frequency identification (RFID) security method, comprising the steps of:

a. transmitting a trigger signal to an RFID tag by a reader, wherein the RFID tag is configured in an electronic device;

b. enabling a timer of the electronic device to count a duration of time; and c. a controller of the electronic device denying an access of the electronic device when the duration of time exceeds a predetermined time duration.

7. The RFID security method as claimed in claim 6, wherein the step a further comprises the steps of:

a1. the reader receiving a tag ID code of the RFID tag, and transmitting the tag ID code to a server, wherein the server stores a predetermined ID code;

a2. the server determining whether the tag ID code is the same as the predetermined ID code;

a3. when the tag ID code is the same as the predetermined ID code, the server transmitting an enable signal to the RFID tag to grant the access of the electronic device through the controller of the electronic device.

8. The RFID security method as claimed in claim 6, wherein the step b further comprises the steps of:

b1. stopping to count the duration of time when the electronic device receives an enable signal before the duration of time exceeds the predetermined time duration.

* * * * *